US006192656B1

(12) United States Patent
Takahashi

(10) Patent No.: US 6,192,656 B1
(45) Date of Patent: Feb. 27, 2001

(54) METHOD OF AND APPARATUS FOR PACKAGING CYLINDRICAL ARTICLE

(75) Inventor: Hisashi Takahashi, Minamiashigara (JP)

(73) Assignee: Fuji Photo Film Co., Ltd., Kanagawa-Ken (JP)

( * ) Notice: Subject to any disclaimer, the term of this patent is extended or adjusted under 35 U.S.C. 154(b) by 0 days.

(21) Appl. No.: 09/323,128

(22) Filed: Jun. 1, 1999

(30) Foreign Application Priority Data

Jun. 1, 1998 (JP) ..... 10-151164

(51) Int. Cl.[7] ..... B65B 11/54; B65B 25/24

(52) U.S. Cl. ..... 53/409; 53/204; 53/217; 53/370; 53/372.9

(58) Field of Search ..... 53/409, 204, 217, 53/370, 372.8, 372.9

(56) References Cited

U.S. PATENT DOCUMENTS

| | | | | |
|---|---|---|---|---|
| 1,629,525 | * | 5/1927 | Parsons | 53/372.8 X |
| 2,049,759 | * | 8/1936 | Blosser et al. | 53/204 |
| 2,274,745 | * | 3/1942 | Schultz et al. | 53/204 X |
| 2,301,016 | * | 11/1942 | Cannard | 53/204 |
| 2,363,751 | * | 11/1944 | Schultz et al. | 53/204 |
| 2,380,816 | * | 7/1945 | Witbro | 53/409 |
| 3,296,772 | * | 1/1967 | Barker | 53/372.8 |
| 3,298,159 | * | 1/1967 | Colsman | 53/217 X |
| 3,807,132 | * | 4/1974 | Kamiya | 53/372.8 X |
| 4,164,110 | * | 8/1979 | Soubeyrat | 53/409 |
| 4,184,307 | * | 1/1980 | Kataoka | 53/372.9 X |
| 4,524,562 | * | 6/1985 | Yagi et al. | 53/204 X |
| 4,525,984 | * | 7/1985 | Kollross | 53/370 X |
| 4,536,175 | * | 8/1985 | Arnold | 53/370 X |
| 4,625,493 | * | 12/1986 | Yagi et al. | 53/204 X |
| 4,651,500 | * | 3/1987 | Chaffey | 53/372.9 X |
| 4,845,919 | * | 7/1989 | Fujii et al. | 53/204 X |
| 5,016,430 | * | 5/1991 | Itoh et al. | 53/211 X |
| 5,771,659 | * | 6/1998 | Hansen | 53/370 X |
| 5,987,847 | * | 11/1999 | Nordstrom et al. | 53/372.9 X |

FOREIGN PATENT DOCUMENTS

| | | |
|---|---|---|
| 0 129 162 | 12/1984 | (EP) . |
| 0 382 664 | 8/1990 | (EP) . |
| 1 013 699 | 12/1965 | (GB) . |
| 2-1202 | 1/1990 | (JP) . |
| 2-109817 | 4/1990 | (JP) . |
| 2-42564 | 11/1990 | (JP) . |

OTHER PUBLICATIONS

Patent Abstracts of Japan vol. 014, No. 327 (M–0998) Jul. 13, 1990 & JP 02 109817 A (Fuji Tekkosho:KK) Apr. 23, 1990 *Abstract.

Patent Abstracts of Japan vol. 098, No. 001 Jan. 30, 1998 & JP 09 245919 A (Fuji Tekkosho: KK Sep. 30, 1997 *Abstract.

* cited by examiner

*Primary Examiner*—John Sipos
(74) *Attorney, Agent, or Firm*—Sughrue, Mion, Zinn, Macpeak & Seas, PLLC

(57) ABSTRACT

A packaging apparatus packages a cylindrical article having a hollow region therein by gathering an end of a wide packaging sheet wrapped around the cylindrical article, and pressing the gathered end into the hollow region in the cylindrical article. The gathered end of the packaging sheet is pressed into the hollow region in the cylindrical article by a presser which has an outside diameter smaller than the diameter of the hollow region and an inside diameter greater than the outside diameter of a core tube used to gather the end of the packaging sheet. The core tube is withdrawn from the hollow region before the gathered end of the packaging sheet is fully pressed into the hollow region by the presser. The packaging apparatus can reliably gather and squeeze a packaging sheet having long opposite ends. Since the gathered end is pressed into the hollow region in the cylindrical article, the hollow region can be sealed against entry of humidity, air, and light without use of special members such as labels or plastic caps.

9 Claims, 5 Drawing Sheets

10
114
112
110
28
104
24
102
100
88
90
106
108
22
86
84
120a
122a
40a
40d
120d
124b
120f
26
40b
122b
120b
80
70b
66
68
56
58b
62
60
12
14
54b
52
50
44

METHOD OF AND APPARATUS FOR PACKAGING CYLINDRICAL ARTICLE

BACKGROUND OF THE INVENTION

1. Field of the Invention

The present invention relates to a method of and an apparatus for gathering an end of a wide packaging sheet wrapped around a cylindrical article and pressing the gathered end into a hollow region in the cylindrical article, and more particularly to a method of and an apparatus for packaging a cylindrical article such as a roll of photosensitive material or thermosensitive recording material, for example.

2. Description of the Related Art

There have heretofore been proposed various packaging apparatuses for wrapping a cylindrical article with a wide packaging sheet and gathering opposite ends of the packaging sheet. For details of known packaging apparatuses of the type described above, reference should be made to Japanese utility model publication No. 2-1202, Japanese utility model publication No. 2-42564, and Japanese laid-open patent publication No. 2-109817.

The packaging apparatus disclosed in Japanese utility model publication No. 2-1202 and Japanese utility model publication No. 2-42564 use a packaging sheet whose opposite end dimensions are smaller than the radius of a cylindrical article to be packaged, and folds the ends of the packaging sheet along the ends of the cylindrical article. These publications are silent about an apparatus for using a packaging sheet whose opposite end dimensions are greater than the radius of a cylindrical article to be packaged, and gathering the opposite ends of the packaging sheet and forcing the gathered ends into a hollow region in the cylindrical article.

The packaging apparatus disclosed in Japanese laid-open patent publication No. 2-109817 use a packaging sheet whose opposite end dimensions are greater than the radius of a cylindrical article to be packaged, and gathers the ends of the packaging sheet. A suction pipe draws the packaging sheet when the suction pipe is positioned within a hollow region in the cylindrical article, so that an opening remains in the hollow region in the cylindrical article after the cylindrical article is packaged. In addition, the packaging sheet cannot strongly be gathered in the hollow region in the cylindrical article, and hence the hollow region in the cylindrical article cannot be sealed against entry of humidity, air, and light.

When photosensitive and thermosensitive recording materials are packaged, it is highly important to seal them particularly against entry of humidity and light.

It has been the customary practice to paste labels to the ends of or press plastic caps into the hollow regions in the packaged cylindrical articles for thereby sealing the hollow regions against entry of humidity and light.

The strength with which the ends of a packaging sheet are gathered is governed by the state of contact between a bent arm and a suction pipe which are used to gather the ends of the packaging sheet. However, since a rack and pinion mechanism is used to close the bent arm, a complex adjustment process is required to uniformize the contacting states of individual bent arms. Furthermore, since the thickness of the packaging sheet as it is gathered between the bent arm and the suction pipe progressively increases in the gathering process, the strength with which the ends of the packaging sheet are gathered is not stable.

SUMMARY OF THE INVENTION

It is therefore an object of the present invention to provide a method of and an apparatus for packaging a cylindrical article with a packaging sheet by reliably gathering opposite ends of the packaging sheet which are relatively long, and pressing the gathered ends into a hollow region in the cylindrical article to seal the hollow region in the cylindrical article against entry of humidity, air, and light without use of special members such as labels or plastic caps.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

A method of and an apparatus for packaging a cylindrical article with a packaging sheet, as they are applied to a packaging apparatus for packaging a cylindrical roll of photosensitive or thermosensitive recording material (hereinafter referred to as an article) with a packaging sheet, will be described below with reference to FIGS. 1 through 5C.

Figure 1:
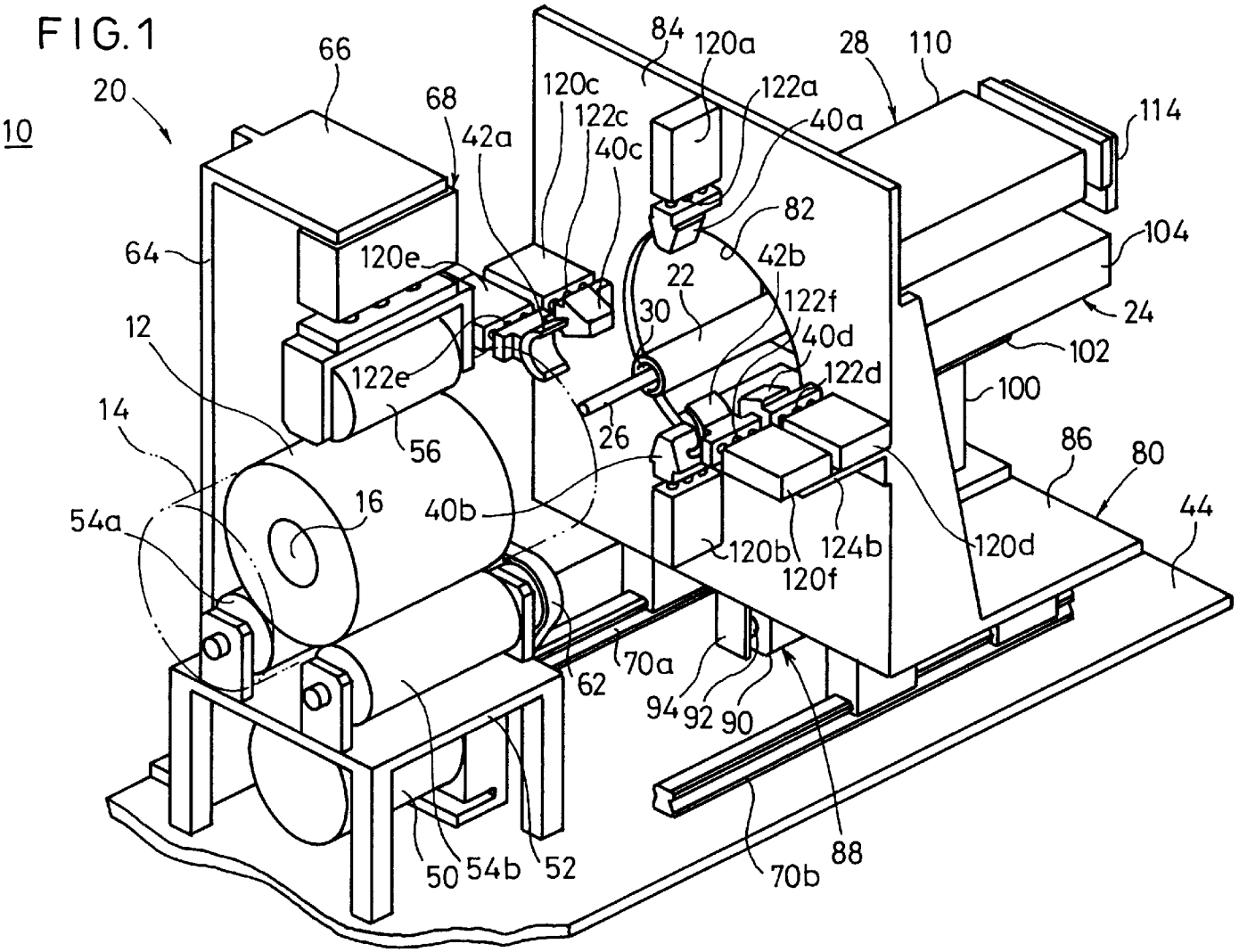
FIG. 1 is a perspective view of a packaging apparatus according to the present invention.
Figure 2:
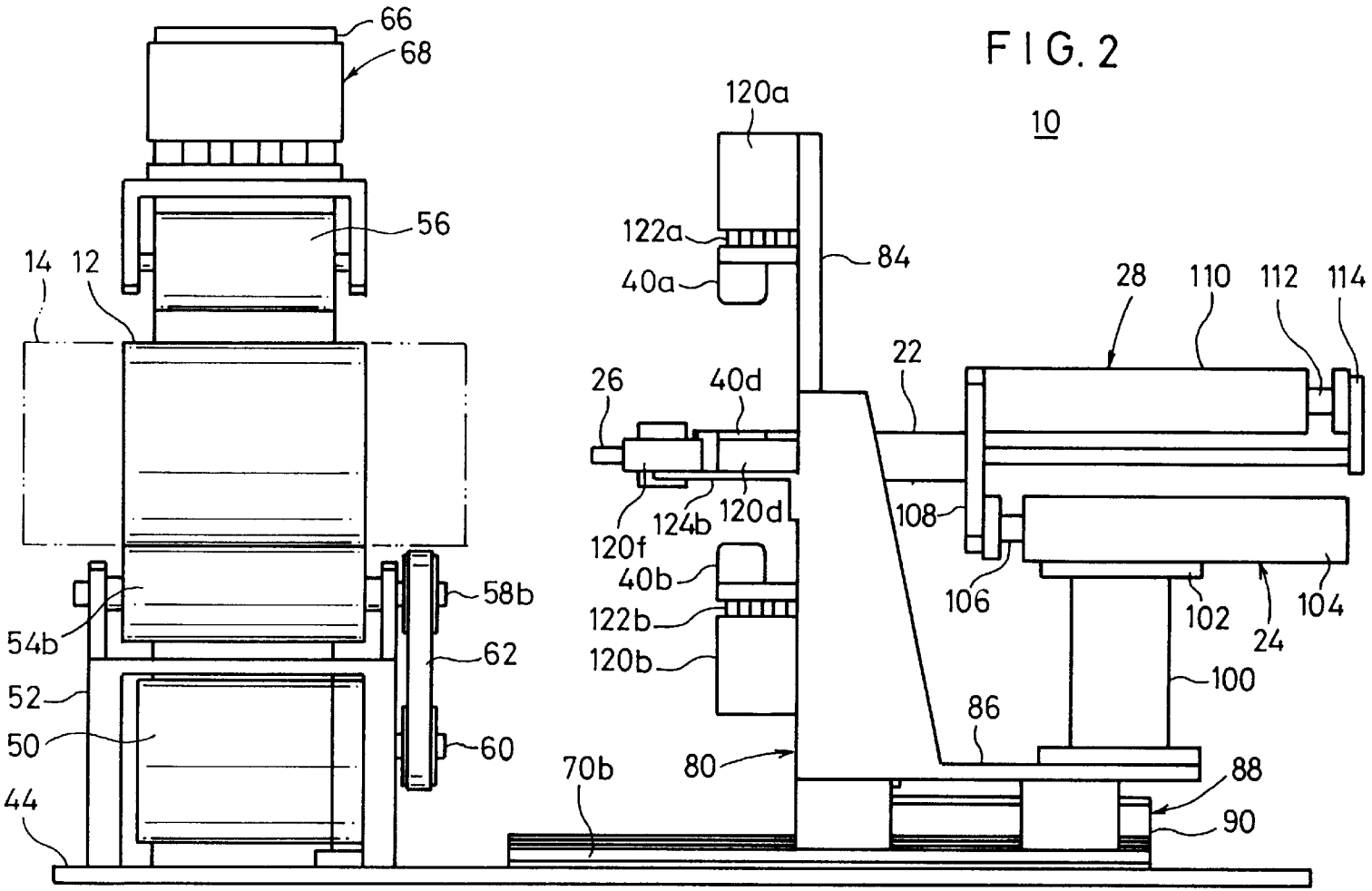
FIG. 2 is a side elevational view of the packaging apparatus according to the present invention.
Figure 3:
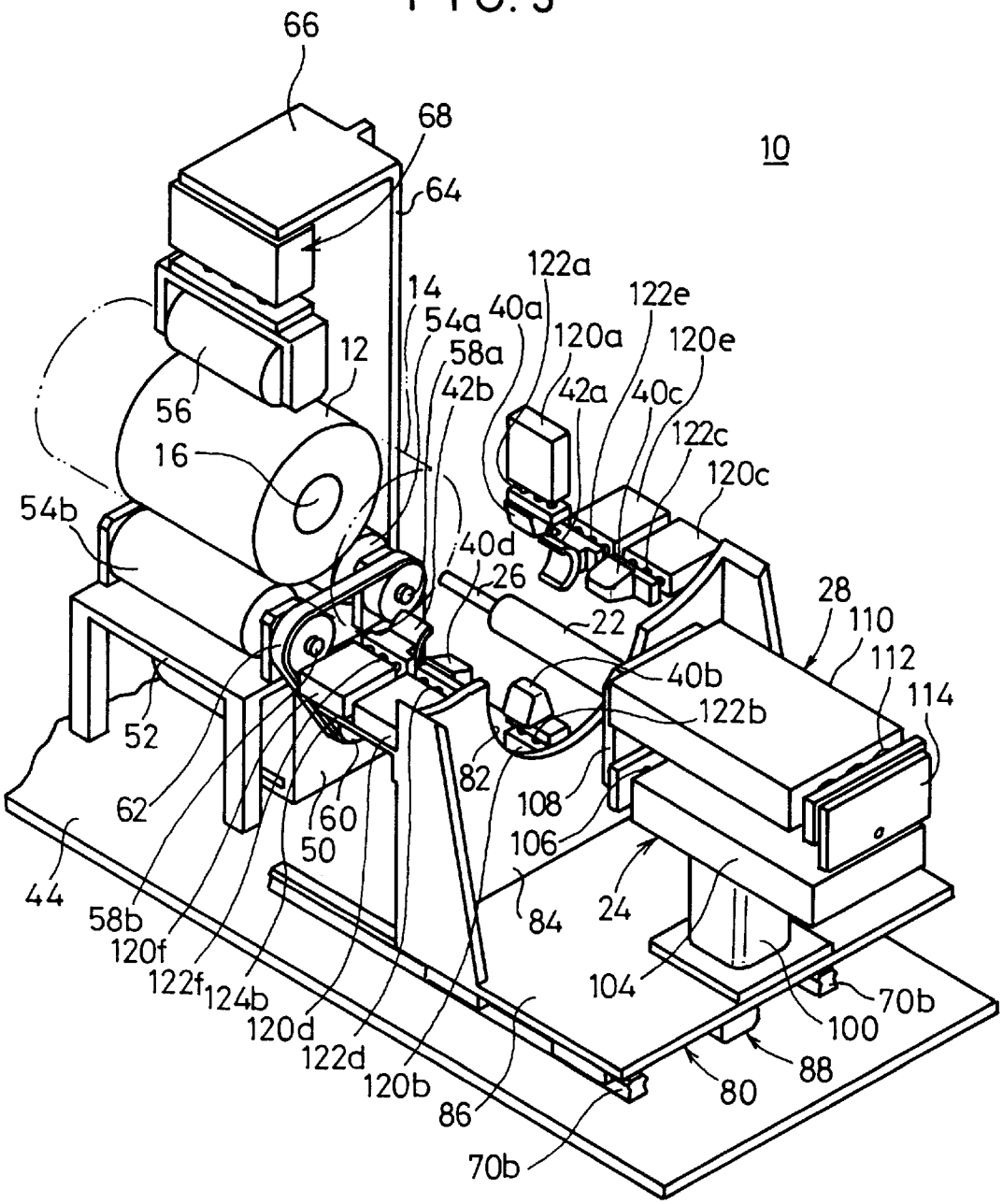
FIG. 3 is a perspective view, partly broken away, of the packaging apparatus according to the present invention.

As shown in FIGS. 1, 2 and 3, a packaging apparatus 10 gathers an end of a wide packaging sheet 14 wrapped around an article 12 and presses the gathered end into a hollow region 16 in the article 12. The packaging apparatus 10 comprises an actuating mechanism 20 for rotating the article 12 wrapped by the packaging sheet 14, a cylindrical presser 22 for pressing the gathered end into the hollow region 16 in the article 12, the cylindrical presser 22 having an outside diameter smaller than the diameter of the hollow region 16 in the article 12, a first reciprocating mechanism 24 for moving the presser 22 in directions toward and away from the article 12, a cylindrical core tube 26 mounted axially movably in and through a hollow region in the cylindrical presser 22, and a second reciprocating mechanism 28 for moving the core tube 26 in directions toward and away from the article 12. The presser 22 has a recess 30 defined in a distal end thereof for receiving a gathered end of the packaging sheet 14.

In the illustrated embodiment, the presser 22, the actuating mechanism 20, and other associated components are positioned on one side of the article 12. Actually, however, there are two sets of these components positioned respectively on both sides of the article 12 for gathering opposite ends of the packaging sheet 14 projecting from opposite ends of the article 12 and pressing the gathered opposite ends of the packaging sheet 14 into the hollow region 16 in the article 12.

The packaging apparatus 10 also has a plurality of (four in the illustrated embodiment) first packaging sheet holders 40*a* through 40*d* arranged in a circular pattern concentric with the presser 22 and movable radially of the article 12, and a plurality of (two in the illustrated embodiment) second packaging sheet holders 42*a*, 42*b* arranged in a circular pattern concentric with the presser 22 and disposed axially inwardly closer to the article 12 than the first packaging sheet holders 40*a* through 40*d*, the second packaging sheet holders 42*a*, 42*b* being movable radially of the article 12.

The actuating mechanism 20 comprises a motor 50 fixedly mounted on a base 44, a roller table 52 disposed in covering relation to the motor 50, two drive rollers 54*a*, 54*b* rotatably mounted on the roller table 52 and having respective axes substantially parallel to each other, the drive rollers 54*a*, 54*b* being rotatable in the same direction by the motor 50, and a roller 56 for pressing the article 12 placed on the drive rollers 54*a*, 54*b* downwardly and rotating the article 12 about its own axis.

The two drive rollers 54*a*, 54*b* can be rotated in the same direction by a belt 62 which is trained around respective shafts 58*a*, 58*b* of the drive rollers 54*a*, 54*b* and a shaft 60 of the motor 50. The roller 56 is suspended from a horizontal plate 66 of a substantially L-shaped support 64 which extends vertically along side of the roller table 52, and is positioned above the two drive rollers 54*a*, 54*b*. A third reciprocating mechanism 68 is disposed between the roller 56 and the horizontal plate 66. The third reciprocating mechanism 68 reciprocally moves vertically to move the roller 56 in directions toward and away from the article 12 placed on the two drive rollers 54*a*, 54*b*.

The presser 22, the core tube 26, and other components, except for the actuating mechanism 20, are mounted on a movable table 80, which is made of metal, for example, that is reciprocally movable on and along two rails 70*a*, 70*b* disposed on the base 44.

The movable table 80 has a substantially L-shaped cross section, and includes a vertical attachment panel 84 which extends upwardly between the two rails 70*a*, 70*b* and has a central circular opening 82 defined therein, and a horizontal fixed panel 86 integrally formed with and extending backward from a lower end of the vertical attachment panel 84.

The movable table 80 is movable in directions toward and away from the actuating mechanism 20 by a fourth reciprocating mechanism 88 which is disposed on the base 44 centrally between the two rails 70*a*, 70*b*. Specifically, the fourth reciprocating mechanism 88 comprises an air cylinder 90 positioned on the base 44 centrally between the two rails 70*a*, 70*b*, and a piston rod 92 projecting from the air cylinder 90 in a direction toward the actuating mechanism 20. The fourth reciprocating mechanism 88 also has a tongue 94 extending downwardly from the fixed panel 86 and secured to the distal end of the piston rod 92.

When the piston rod 92 is reciprocally moved by the air cylinder 90, the movable table 80 moves in directions toward and away from the actuating mechanism 20 along the two rails 70*a*, 70*b*.

A prismatic support column 100 is vertically mounted on a rear central portion of the fixed panel 86. The first reciprocating mechanism 24 comprises a horizontal air cylinder 104 mounted on a support plate 102 which is disposed on an upper surface of the support column 100. The air cylinder 104 has a piston rod 106 extending horizontally in a direction toward the central opening 82 in the movable table 80.

A first attachment plate 108 is vertically fixed to a distal end of the piston rod 106. The presser 22 has an end fixed centrally to a vertical principal surface of the first attachment plate 108 which faces the central opening 82. The distal end of the piston rod 106 is fixed to a lower portion of another vertical principal surface of the first attachment plate 108 which faces away from the central opening 82. The presser 22 is fixed to the first attachment plate 108 in such a position that the axis of the presser 22 and the axis of the article 12 rotatably supported by the drive rollers 54*a*, 54*b* and the roller 56 are in substantial alignment with each other.

The second reciprocating mechanism 28 comprises a horizontal air cylinder 110 fixed to an upper portion of the other vertical principal surface of the first attachment plate 108. The air cylinder 110 has a piston rod 112 projecting backward in a direction away from the central opening 82.

A second attachment plate 114 is vertically fixed to a distal end of the piston rod 112. Specifically, the distal end of the piston rod 112 is fixed to a vertical principal surface of the second attachment plate 114, and the core tube 26 has a rear end which is also fixed to the same vertical principal surface of the second attachment plate 114. The core tube 26 is fixed to the second attachment plate 114 in such a position that the axis of the core tube 26 and the axis of the presser 22 are in substantial alignment with each other.

The four first packaging sheet holders 40*a* through 40*d* and the two second packaging sheet holders 42*a*, 42*b* are mounted on a vertical principal surface of the vertical attachment panel 84 which faces the actuating mechanism 20.

Specifically, first and second air cylinders 120*a*, 120*b* are directly fixed to the vertical principal surface of the attachment panel 84 in respective positions above and below the central opening 82 in the attachment plate 84. The first and second air cylinders 120*a*, 120*b* have respective piston rods 122*a*, 122*b* whose distal ends confront each other. First and second plates 124*a* (not shown), 124*b* are integrally mounted on the vertical principal surface of the attachment panel 84 in respective positions leftward and rightward of the central opening 82 in the attachment plate 84, the first and second plates 124*a*, 124*b* projecting horizontally toward the actuating mechanism 20. Third and fourth air cylinders 120*c*, 120*d* are fixedly mounted on respective upper surfaces of the first and second plates 124*a*, 124*b* closely to the attachment panel 84, the third and fourth air cylinders 120*c*, 120*d* having respective piston rods 122*c*, 122*d* whose distal ends confront each other.

Fifth and sixth air cylinders 120*e*, 120*f* are also fixedly mounted on the respective upper surfaces of the first and second plates 124*a*, 124*b* closely to their free ends and parallel to the third and fourth air cylinders 120*c*, 120*d*, the fifth and sixth air cylinders 120*e*, 120*f* having respective piston rods 122*e*, 122*e* whose distal ends confront each other.

The first packaging sheet holders 40*a* through 40*d* are mounted on the piston rods 122*a* through 122*d*, respectively, of the first through fourth air cylinders 120*a* through 120*d*. The first packaging sheet holders 40*a* through 40*d* are tapered toward their distal ends, and their distal ends are curved with a radius of curvature which is slightly greater than the radius of the presser 22. The second packaging sheet holders 42*a*, 42*b* are mounted on the piston rods 122*e*, 122*f*, respectively, of the fifth and sixth air cylinders 120*e*, 120*f*. The second packaging sheet holders 42*a*, 42*b* comprise arcuate members whose radius of curvature is slightly greater than the radius of the presser 22.

The packaging apparatus 10 is basically of the above structure. Operation and advantages of the packaging apparatus 10 will be described below with reference to FIGS. 4A through 4C and FIGS. 5A through 5C.

Figure 4A:
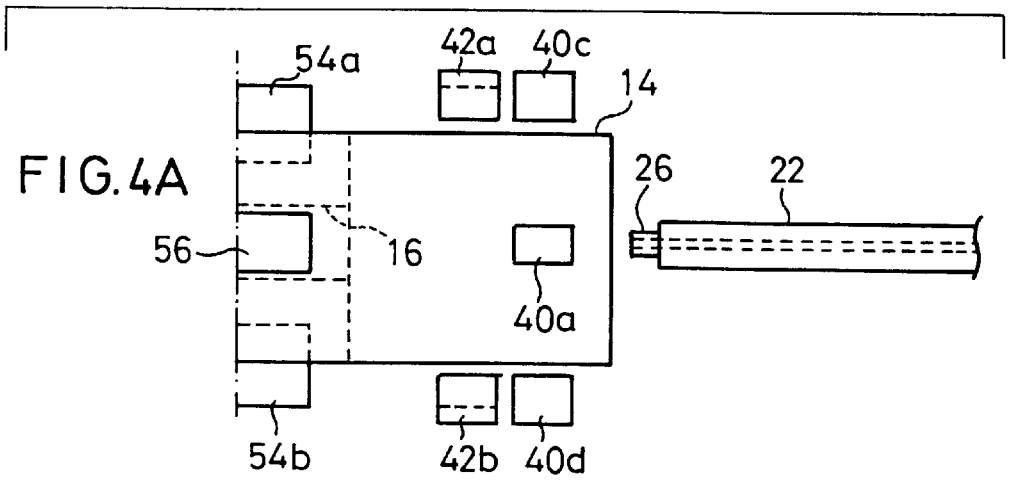
FIG. 4A is a view illustrative of the manner in which an article to be packaged is placed on drive rollers.

As shown in FIG. 4A, the article 12 wrapped by the wide packaging sheet 14 is placed on the two drive rollers 54*a*, 54*b*. At this time, a position to be occupied by the movable table 80 is determined depending on the width (height) of the article 12, and the movable table 80 is moved to the determined position by the fourth reciprocating mechanism 88.

Figure 4B:
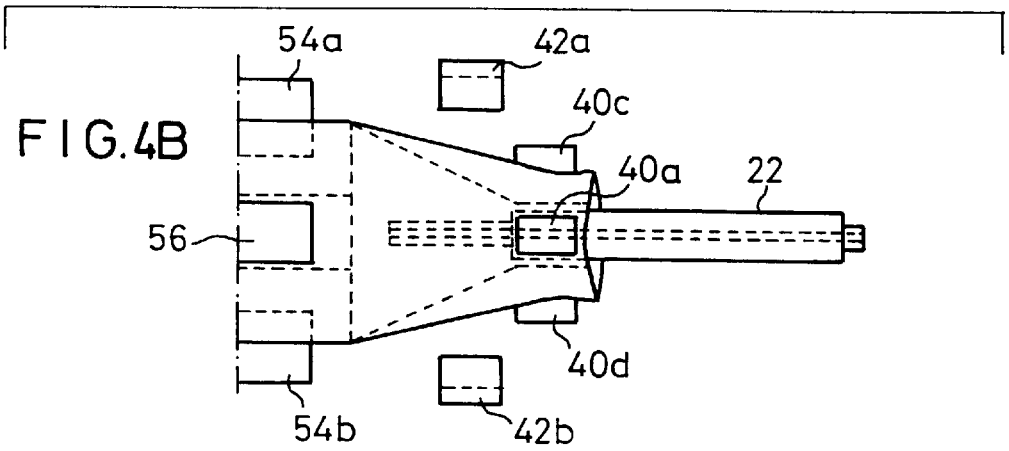
FIG. 4B is a view illustrative of the manner in which a packaging sheet is tentatively fixed by first packaging sheet holders and starts being gathered.

Then, as shown in FIG. 4B, the first reciprocating mechanism 24 is actuated to move the presser 22 in a direction toward the article 12 until the distal end of the presser 22 reaches a position corresponding to an end of the packaging sheet 14. At the same time that the presser 22 is thus moved, the second reciprocating mechanism 28 is actuated to cause the distal end of the core tube 26 to project from the distal end of the presser 22.

Subsequently, the first through fourth air cylinders 120*a* through 120*d* are actuated to move the first packaging sheet holders 40*a* through 40*d* radially toward each other to press the end of the packaging sheet 14 to surround the distal end portion of the presser 22. At this time, the end of the packaging sheet 14 is tentatively secured in position.

The third reciprocating mechanism 68 is actuated to lower the roller 56 to press the article 12 on the drive rollers 54*a*, 54*b* downwardly. The motor 50 is energized to rotate the drive rollers 54*a*, 54*b* in one direction about their axes. The article 12 wrapped by the wide packaging sheet 14 is rotated in a direction opposite to the direction in which the drive rollers 54*a*, 54*b* are rotating.

Figure 4C:
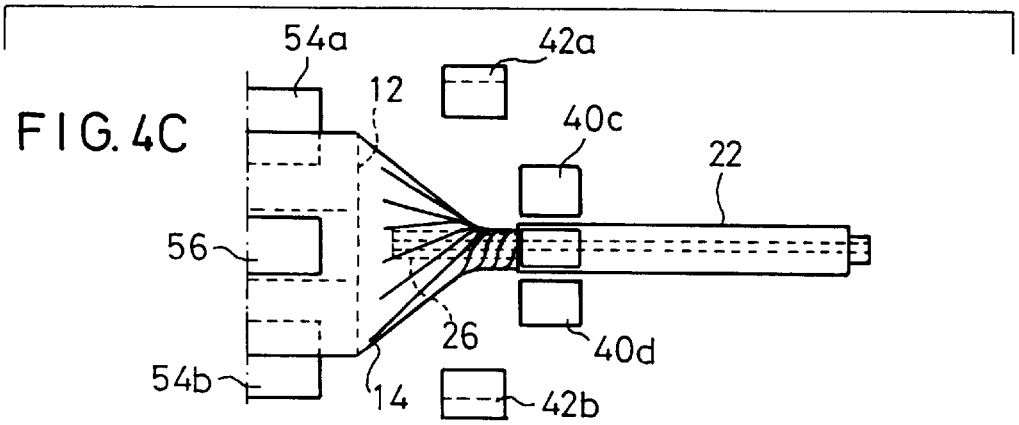
FIG. 4C is a view illustrative of the manner in which a gathered end of the packaging sheet moves toward the article to be packaged as the end of the packaging sheet is progressively gathered.

When the packaging sheet 14 rotates together with the article 12, as shown in FIG. 4C, the end of the packaging sheet 14 is gathered and squeezed so as to be coiled around the core tube 26. At the same time, the end of the packaging sheet 14 is displaced progressively toward the end of the article 12.

Figure 5A:
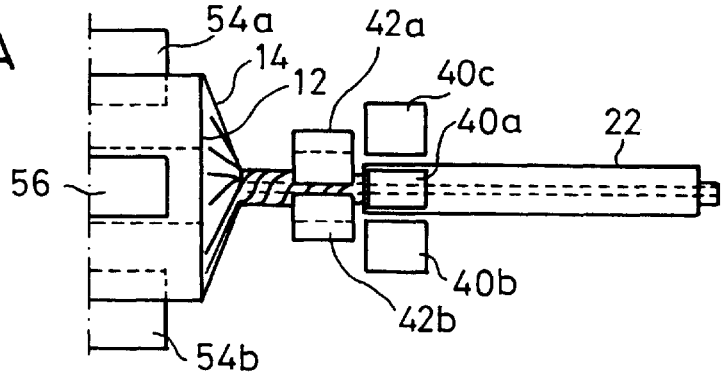
FIG. 5A is a view illustrative of the manner in which the gathered end of the packaging sheet is held by second packaging sheet holders.

Then, as shown in FIG. 5A, before the end of the packaging sheet 14 is separated from the first packaging sheet holders 40*a* through 40*d*, the fifth and sixth air cylinders 120*e*, 120*f* are actuated to move the second packaging sheet holders 42*a*, 42*b* toward each other to grip the end of the packaging sheet 14 which has been coiled around the core tube 26. As a result, the packaging sheet 14 can continuously be gathered and squeezed after the gathered end of the packaging sheet 14 is disengaged from the first packaging sheet holders 40*a* through 40*d*.

Figure 5B:
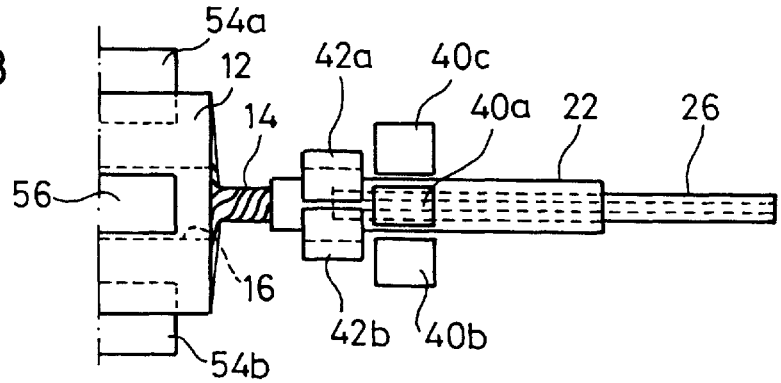
FIG. 5B is a view illustrative of the manner in which a pusher is moved toward the article to be packaged upon completion of the end gathering, and a core tube is moved away from the article to be packaged.

When the packaging sheet 14 is sufficiently gathered and squeezed, as shown in FIG. 5B, the core tube 26 is moved away from the article 12 by the second reciprocating mechanism 28, and the presser 22 is moved toward the article 12 by the first reciprocating mechanism 24. At this time, air in the hollow region 16 in the article 12 is drawn through the core tube 26.

Figure 5C:
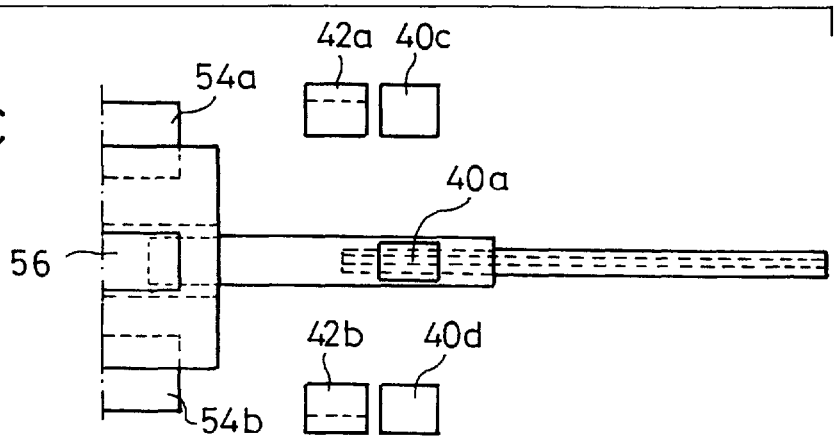
FIG. 5C is a view illustrative of the manner in which the gathered end of the packaging sheet is pressed into a hollow region in the article.

As shown in FIG. 5C, the movement of the presser 22 toward the article 12 presses the gathered end of the packaging sheet 14 into the hollow region 16 in the article 12. Since the recess 30 (see FIG. 1) is defined in the distal end of the presser 22 for receiving the gathered end of the packaging sheet 14, the gathered end of the packaging sheet 14 is reliably pressed into the hollow region 16 in the article 12 without the danger of being released and spread radially outwardly.

As described above, the second packaging sheet holders 42*a*, 42*b* comprise arcuate members whose radius of curvature is slightly greater than the radius of the presser 22. Therefore, when the presser 22 moves, the second packaging sheet holders 42*a*, 42*b* serve to guide the gathered end of the packaging sheet 14 toward and into the hollow region 16 in the article 12, so that the gathered end of the packaging sheet 14 can reliably be pressed into the hollow region 16 in the article 12.

After the gathered end of the packaging sheet 14 is pressed into the hollow region 16 in the article 12, the first packaging sheet holders 40*a* through 40*d* are moved radially outwardly away from each other by the first through fourth air cylinders 120*a* through 120*d*, and the second packaging sheet holders 42*a*, 42*b* are moved radially outwardly away from each other by the fifth and sixth air cylinders 120*e*, 120*f*, until the first packaging sheet holders 40*a* through 40*d* and the second packaging sheet holders 42*a*, 42*b* return to their initial positions. Subsequently, the first reciprocating mechanism 24 is actuated to move the presser 22 away from the article 12 to the initial position shown in FIG. 4A.

As described above, when the gathered end of the packaging sheet 14 is pressed into the hollow region 16 in the article 12 by the presser 22, the core tube 26 is moved in the direction opposite to the direction in which the presser 22 moves, and withdrawn from the gathered end of the packaging sheet 14. Therefore, no hole remains centrally in the gathered end of the packaging sheet 14 due to the core tube 26, and the article 12, particularly the hollow region 16 therein, is securely sealed against humidity and air.

The presser 22 which is pressed into the hollow region 16 in the article 12 has its outside diameter smaller than the diameter of the hollow region 16 in the article 12, and its inside diameter greater than the outside diameter of the core tube 26. Consequently, it is possible to press the gathered end of the packaging sheet 14 into the hollow region 16 in the article 12 with the presser 22, and to move the core tube 22 through the bore in the presser 22 toward and away from the hollow region 16 in the article 12. As a result, the core tube 26 can easily be withdrawn before the gathered end of the packaging sheet 14 is fully pressed into the hollow region 16 in the article 12.

At the time of coiling the end of the packaging sheet 14 around the core tube 26, as the end of the packaging sheet 14 is gathered and squeezed around the distal end portion of the core tube 26, the end of the packaging sheet 14 which has tentatively been secured in position on the distal end portion of the core tube 26 by the first packaging sheet holders 40*a* through 40*d* is progressively pulled toward the article 12 as the end of the packaging sheet 14 is gathered and squeezed, until finally the end of the packaging sheet 14 is disengaged from the distal end portion of the presser 22.

In a next stage, the distal end portion of the core tube 26 around which the packaging sheet 14 is coiled is held by the second packaging sheet holders 42*a*, 42*b*. Therefore, the packaging sheet 14 can continuously be gathered and squeezed after the gathered end of the packaging sheet 14 is disengaged from the first packaging sheet holders 40*a* through 40*d*.

In as much as the second packaging sheet holders 42*a*, 42*b* can guide the gathered end of the packaging sheet 14 toward and into the hollow region 16 in the article 12, the gathered end of the packaging sheet 14 can reliably be pressed into the hollow region 16 in the article 12.

Because the gathered end of the packaging sheet 14 is pressed into the hollow region 16 in the article 12 while the article 12 is rotating, the gathered end of the packaging sheet 14 is further twisted and coiled in the hollow region 16. Accordingly, the packaging sheet 14 is effective to seal the hollow region 16 against entry of humidity, air, and light.

Furthermore, at the same time that the presser 22 is moved toward the article 12 which is rotating, the core tube 26 is moved away from the article 12. Consequently, any significant hole is effectively prevented from remaining centrally in the gathered end of the packaging sheet 14 on account of the core tube 26.

Moreover, air in the hollow region 16 in the article 12 is drawn through the core tube 26 while the end of the packaging sheet 14 is being gathered. Generally, when the gathered end of the packaging sheet 14 is pressed into the hollow region 16 in the article 12, if the pressure in the hollow region 16 is high and the width of the article 12 is small, then problems arise in that it becomes difficult to press the gathered end of the packaging sheet 14 into the hollow region 16 in the article 12 with the presser 22, and the gathered end of the packaging sheet 14 which has been pressed into the hollow region 16 in the article 12 tends to be forced out. According to the present invention, however, since air in the hollow region 16 in the article 12 is drawn through the core tube 26, such problems can be obviated.

The presser 22, the core tube 26, the first packaging sheet holders 40*a* through 40*d*, and the second packaging sheet holders 42*a*, 42*b* are installed on the movable table 80, which can be moved toward and away from the article 12 by the fourth reciprocating mechanism 88. Accordingly, articles 12 having different widths (heights) can easily be handled simply by changing the position of the movable table 80.

The first packaging sheet holders 40*a* through 40*d* are movable toward and away from each other by the first through fourth air cylinders 120*a* through 120*d*, and the second packaging sheet holders 42*a*, 42*b* are movable toward and away from each other by the fifth and sixth air cylinders 120*e*, 120*f*. When the thickness and frictional resistance of the packaging sheet 14 are changed, such changes can easily be coped with by changing forces with which the gathered end of the packaging sheet 14 is held by the first packaging sheet holders 40*a* through 40*d* and the second packaging sheet holders 42*a*, 42*b*.

In the illustrated embodiment, the article 12 is rotated by the drive rollers 54*a*, 54*b*. However, the article 12 may be rotated by a wrapper belt rather than the drive rollers 54*a*, 54*b*.

In the illustrated embodiment, the present invention is applied to the packaging apparatus which packages a roll of photosensitive material or thermosensitive recording material that has tentatively been packaged. However, the principles of the present invention are also applicable to the packaging of all cylindrical articles which need to be sealed against entry of humidity, air, and light.

Although a certain preferred embodiment of the present invention has been shown and described in detail, it should be understood that various changes and modifications may be made therein without departing from the scope of the appended claims.

What is claimed is:

1. A method of packaging a cylindrical article having a packaging sheet wrapped therearound, the cylindrical article having a hollow region therein, comprising the steps of:

(a) moving a distal end of a presser disposed in opposition to the cylindrical article and having a core tube mounted axially therein, toward the cylindrical article to a position wherein said distal end of said presser is accommodated within an end of the packaging sheet;

(b) projecting a distal end portion of said core tube from said distal end of said presser into the cylindrical article;

(c) holding, using a plurality of first packaging sheet holders disposed concentrically around said presser, said end of the packaging sheet against the distal end of said presser while the distal end of said presser is accommodated within the end of the packaging sheet;

(d) rotating said cylindrical article such that the end of the packaging sheet is coiled and gathered onto said distal end portion of said core tube;

(e) holding, using a plurality of second packaging sheet holders disposed concentrically around said presser and disposed axially inwardly closer to the cylindrical article than said first packaging sheet holders, said coiled packaging sheet against the distal end portion of said core tube on which said packaging sheet is coiled; and (f) moving said presser toward the rotating cylindrical article when the end of the packaging sheet is fully gathered on said core tube, to press the gathered end of the packaging sheet into the hollow region in the cylindrical article;

wherein said core tube is withdrawn by moving said core tube axially away from the hollow region before the gathered end of the packaging sheet is fully pressed by said presser into said hollow region.

2. The method according to claim 1, wherein said presser has an outside diameter smaller than a diameter of the hollow region and an inside diameter greater than an outside diameter of said core tube.

3. The method according to claim 1, wherein said moving step (f) comprises the step of moving said core tube away from the cylindrical article at a same time as said presser is moved toward the rotating cylindrical article.

4. A method according to claim 1, further comprising the step of drawing air from the hollow region through said core tube while the end of the packaging sheet is being gathered.

5. An apparatus for packaging a cylindrical article having a packaging sheet wrapped therearound, the cylindrical article having a hollow region therein, the article being packaged by gathering an end of the packaging sheet and pressing the gathered end into the hollow region in the cylindrical article, comprising:

an actuating mechanism for rotating the cylindrical article to coil and gather the packaging sheet around the cylindrical article;

a presser for pressing the gathered end of the packaging sheet into the hollow region in the cylindrical article, said presser having an outside diameter smaller than a diameter of the hollow region, said presser being disposed coaxially with the cylindrical article and axially movable back and forth;

a core tube fitted in said presser and axially movable back and forth; and means for moving said presser into said hollow region and for moving said core tube axially within said presser, such that said core tube is withdrawn by moving said core tube away from the hollow region of the cylindrical article by said core tube moving means before the gathered end of the packaging sheet is fully pressed into the hollow region by said presser.

6. The apparatus according to claim 5, further comprising:

a plurality of first packaging sheet holders arranged in a circular pattern concentric with said presser and movable radially of the cylindrical article; and a plurality of second packaging sheet holders arranged in a circular pattern concentric with said presser and disposed axially inwardly closer to the cylindrical article than said first packaging sheet holders, said second packaging sheet holders being movable radially of the cylindrical article.

7. The apparatus according to claim 5, further comprising:

a reciprocating mechanism for axially moving said presser toward and away from the cylindrical article.

8. The apparatus according to claim 5, wherein said presser has a recess defined in a distal end thereof for receiving the gathered end of the packaging sheet.

9. The apparatus according to claim 5, wherein said actuating mechanism comprises:

a base;

a motor fixedly mounted on said base;

a roller table disposed above said motor and covering said motor;

two drive rollers rotatably mounted on said roller table and having respective axes substantially parallel to each other, said drive rollers being rotatable in a same direction by said motor; and a roller disposed above said drive rollers and pressing downwardly onto the cylindrical article and rotating the cylindrical article about its own axis.

* * * * *